United States Patent [19]

Woolvin

[11] Patent Number: 4,516,414

[45] Date of Patent: May 14, 1985

[54] SECURITY LOCKING DEVICE FOR OUTDOOR WATER FAUCETS

[76] Inventor: Samuel C. Woolvin, 350 Jackson Pl., Corpus Christi, Tex. 78411

[21] Appl. No.: 482,183

[22] Filed: Apr. 5, 1983

[51] Int. Cl.[3] ..... B65D 55/14

[52] U.S. Cl. ..... 70/164; 70/180; 70/212; 137/385

[58] Field of Search ..... 70/158, 163–173, 70/211–212, 174–180; 137/382–385, 800–801; 220/315; 251/90; 138/89

[56] References Cited

U.S. PATENT DOCUMENTS

| | | | |
|---|---|---|---|
| 1,377,531 | 5/1921 | Voight | 70/180 |
| 4,397,332 | 8/1983 | Sample | 70/177 |

*Primary Examiner*—Robert L. Wolfe

[57] ABSTRACT

This locking device is for outdoor water faucets, and serves to prevent unauthorized use of such faucets. Primarily, it includes a main body or housing, which fits over the handle of the faucet, and is locked in place by a padlock. It further includes a screw cap, which is threaded onto the threaded nozzle of the faucet.

1 Claim, 8 Drawing Figures

SECURITY LOCKING DEVICE FOR OUTDOOR WATER FAUCETS

This invention relates to security devices, and more particularly, to a security locking device for outdoor water faucets.

The principal object of this invention is to provide a security locking device for outdoor water faucets, which will prevent unauthorized use of others' water, nuisance abuse of home faucets, and vandalism of same.

Another object of this invention is to provide a security locking device for outdoor water faucets, which, with water rates continually rising, will save its user money, by preventing unauthorized use of the owner's faucet.

Another object of this invention is to provide a security locking device for outdoor water faucets, which may be fabricated in various sizes to fit all faucets.

A further object of this invention is to provide a security locking device for outdoor water faucets, which may be readily adaptable to accommodate other faucet devices, such as farm fuels, oil nozzles, hydraulic taps, etc.

Other objects are to provide a security locking device for outdoor water faucets, which is simple in design, inexpensive to manufacture, rugged in construction, easy to use, and efficient in operation.

These, and other objects, will be readily evident, upon a study of the following specification, and the accompanying drawing, wherein.

Figure 1:
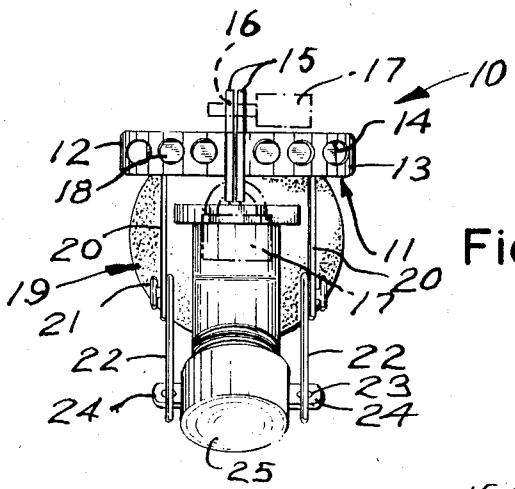
FIG. 1 is a front view of the present invention; shown installed on a faucet, which is shown in elevation, and padlocks are illustrated in phantom.

Accordingly, a device 10 is shown to include a main body 11, consisting of a pair of substantially semi-circular halves 12 and 13, which are provided with a decorative top surface 13*a*, and openings 14 through their sides, for lightness in weight. The halves 12 and 13 further include outwardly projecting hasps 15, which are fixedly secured thereto in a suitable manner, and have openings 16 therethrough, for receiving padlocks 17. The main body or housing 11 is specifically designed to close onto, and encompass the handle of faucet 19, so as to prevent it from being tampered with by unauthorized persons. A link arm 20, of a pair, are each fixedly secured, at one end, to the bottoms of the halves 12 and 13, in a suitable manner, and their opposite ends include a pin 21, which is freely and slidably received in an elongated slot 21*a* in the connected link arms 22. The ends of link arms 22 are freely received in openings 23 of a pair of oppositely opposed lugs 24, which are fixedly secured to the outer periphery of cap 25, in a suitable manner. Cap 25 includes internal threads 26, and a sealing gasket 27, and is received on the threaded end of faucet 19, so as to prevent water flow therefrom.

It shall be noted, that device 10 may be fabricated from brass, anodized metal, very heavy plastics, such as nylon or teflon, and it may be locked in place, either fore, or aft.

Figure 6:
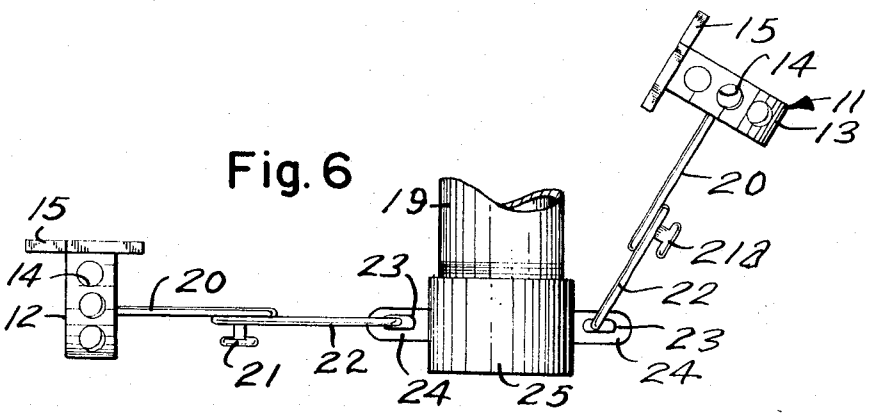
FIG. 6 is an enlarged front elevational view, illustrating the invention in unlocked condition.
Figure 8:
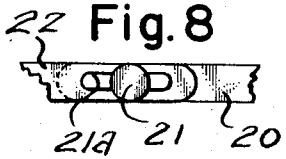
FIG. 8 is a fragmentary side elevational view of the right link assembly, shown removed from the invention.

In use, cap 25 is first threaded onto the nozzle portion of faucet 19. The halves 12 and 13 are then pivoted upward, as is more readily seen in FIG. 6 of the drawing. After the abovementioned, the halves 12 and 13 are then closed together over the faucet handle 18, and the locks 17 are put in place, by being received in the openings 16 of hasps 15.

Figure 2:
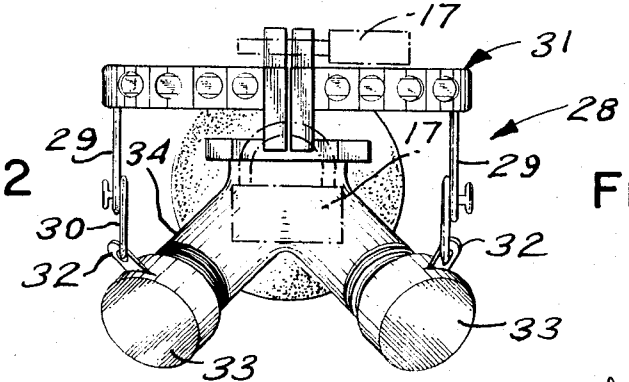
FIG. 2 is similar to FIG. 1, but illustrates a modified form of the invention.
Figure 3:
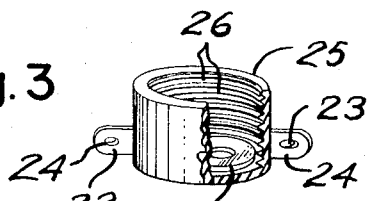
FIG. 3 is a perspective view of the cap member, shown partly broken away, and removed from FIG. 1.
Figure 7:
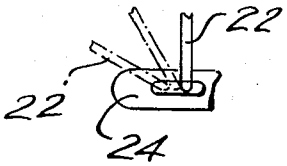
FIG. 7 is a fragmentary side elevational view of the right link assembly, shown removed from FIG. 1, and illustrates different positions in phantom lines.
Figure 5:
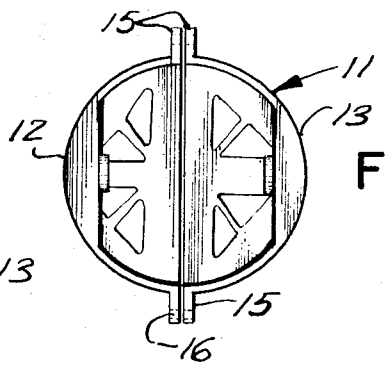
FIG. 5 is a bottom plan view of FIG. 4.
Figure 4:
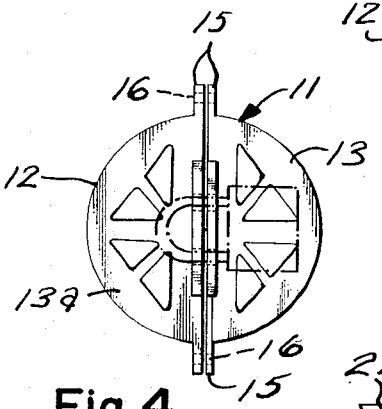
FIG. 4 is a top plan view of the faucet handle cover of FIG. 1.

Referring now to FIG. 2, a modified form of device 28 is similar in construction to device 10, with the exception, that its link arms 29 and 30 are secured to a like main body 31, and are pivotal in a single lug 32 of a pair of caps 33, for threading onto a dual nozzle faucet 34.

In use, modified device 28 functions in the same manner as the heretofore described device 10, with the exception, that device 28 includes two caps 33.

While various changes may be made in the detail construction, it is understood that such changes will be within the spirit and scope of the present invention, as is defined by the appended claims.

I claim:

1. A security locking device for outdoor water faucets, comprising, in combination, a circular main body comprised of two semi-circular body halves, projecting hasps on each end of each said half, an opening in each said hasp, said openings at each end being aligned with each other when said halves encompass and enclose a faucet handle, for receiving a padlock and locking said halves together, a pair of links, each said link being affixed at one end to one said half and its opposite end being pivotally connected to one end of a link arm which at its opposite end to one of a pair of oppositely extending lugs on a cap, and said cap having a screw thread for screwing on a faucet spout.

* * * * *